US009313584B2

(12) United States Patent
Takagi et al.

(10) Patent No.: US 9,313,584 B2
(45) Date of Patent: Apr. 12, 2016

(54) HEARING ASSISTANCE SUITABILITY DETERMINING DEVICE AND HEARING ASSISTANCE SUITABILITY DETERMINING METHOD

(75) Inventors: Yoshiaki Takagi, Kanagawa (JP); Takashi Katayama, Ehime (JP); Hikaru Takato, Miyagi (JP)

(73) Assignee: PANASONIC CORPORATION, Osaka (JP)

( * ) Notice: Subject to any disclaimer, the term of this patent is extended or adjusted under 35 U.S.C. 154(b) by 385 days.

(21) Appl. No.: 13/819,732

(22) PCT Filed: Jul. 3, 2012

(86) PCT No.: PCT/JP2012/004310

§ 371 (c)(1),
(2), (4) Date: Feb. 28, 2013

(87) PCT Pub. No.: WO2013/008412

PCT Pub. Date: Jan. 17, 2013

(65) Prior Publication Data

US 2013/0156240 A1 Jun. 20, 2013

(30) Foreign Application Priority Data

Jul. 8, 2011 (JP) ..... 2011-152335

(51) Int. Cl.
*H04R 25/00* (2006.01)

(52) U.S. Cl.
CPC ..... *H04R 25/50* (2013.01); *H04R 25/70* (2013.01); *H04R 25/552* (2013.01); *H04R 2225/43* (2013.01)

(58) Field of Classification Search
CPC ..... H04R 25/50
USPC ..... 381/320, 314
See application file for complete search history.

(56) References Cited

U.S. PATENT DOCUMENTS

2004/0064066 A1* 4/2004 John et al. ..... 600/559
2005/0008175 A1* 1/2005 Hagen et al. ..... 381/314

(Continued)

FOREIGN PATENT DOCUMENTS

CN 101939784 A 1/2011
JP 2006-087018 3/2006

(Continued)

OTHER PUBLICATIONS

International Search Report issued Sep. 11, 2012 in International (PCT) Application No. PCT/JP2012/004310.

(Continued)

*Primary Examiner* — Duc Nguyen
*Assistant Examiner* — Phan Le
(74) *Attorney, Agent, or Firm* — Wenderoth, Lind & Ponack, L.L.P.

(57) ABSTRACT

A hearing assistance suitability determining device, that determines suitability including whether a subject can clearly hear speech using dichotic hearing assistance, includes: a subject hearing ability information input unit; a hearing ability type determining unit that determines at least one hearing ability type that corresponds to the hearing ability information, based on hearing ability information frequency characteristics; a suitability determining unit that determines suitability for dichotic hearing assistance based on the at least one hearing ability type determined by the hearing ability type determining unit; and suitability presenting unit that presents the suitability determined by the suitability determining unit. The suitability determining unit determines, by referring to a correspondence relationship, suitability based on clarity improvement amount for speech sound corresponding to the determined hearing ability type, the correspondence relationship indicating, for each hearing ability type, degree of perceived speech clarity improvement by the dichotic hearing assistance.

10 Claims, 12 Drawing Sheets

(56) References Cited

U.S. PATENT DOCUMENTS

| | | | | |
|---|---|---|---|---|
| 2005/0283263 | A1* | 12/2005 | Eaton et al. | 700/94 |
| 2008/0082327 | A1 | 4/2008 | Murase et al. | |
| 2011/0004468 | A1 | 1/2011 | Fusakawa et al. | |
| 2011/0142272 | A1 | 6/2011 | Takagi et al. | |

FOREIGN PATENT DOCUMENTS

| | | |
|---|---|---|
| WO | 00/78096 | 12/2000 |
| WO | 2006/136174 | 12/2006 |
| WO | 2010/146825 | 12/2010 |

OTHER PUBLICATIONS

Y. Suzuki et al., "Determination of filtering parameters for dichotic-listening binaural hearing aids", Acoustics 08 Paris, Jun. 29, 2008.
European Search Report issued Mar. 4, 2015 in the corresponding European Patent Application No. 12812091.2.
Chinese Office Action issued Jan. 4, 2016 in connection with corresponding Chinese Patent Application No. 201280002215.6 with partial English translation.

* cited by examiner

FIG. 2B
| | |
|---|---|
| La < Lb ≪ Lc | : High-frequency sloping type |
| La ≤ Lb ≪ Lc | : High-frequency plunging type |
| La < Lb > Lc | : Chevron type |
| La ≒ Lb ≒ Lc | : Flat type |
FIG. 3A
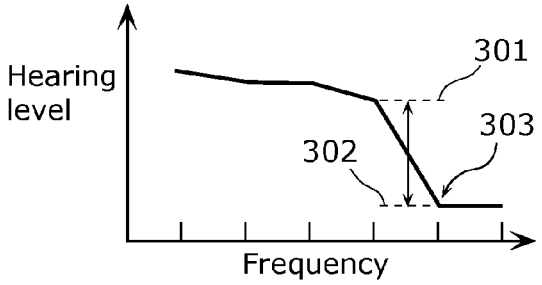
FIG. 3B
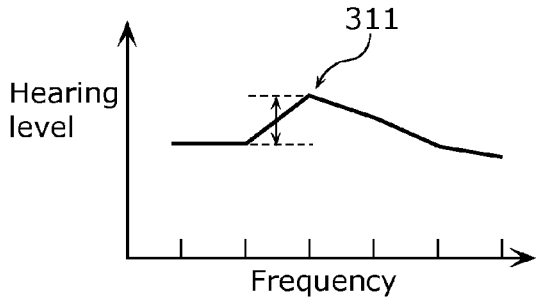
FIG. 3C
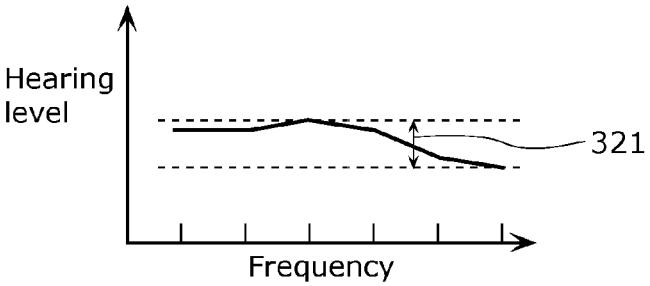

FIG. 4A

107Ia

107m

| Index (i) | Amount of expected improvement for each phoneme (γ)[%] | | | | | | | | | | | | | | | | | | |
|---|---|---|---|---|---|---|---|---|---|---|---|---|---|---|---|---|---|---|---|
| | a | i | u | e | o | k | s | t | n | h | m | y | r | w | g | z | d | b | p |
| High-frequency sloping type | 4 | 11 | 7 | 5 | 5 | 9 | 4 | 9 | | | | | | | 7 | 9 | 16 | 3 | 10 |
| High-frequency plunging type | -2 | 6 | 6 | 2 | -2 | 3 | 0 | 0 | | ● | ● | ● | ● | ● | 3 | -3 | -9 | 0 | -7 |
| Flat type | 0 | 0 | -4 | 0 | 0 | 10 | 10 | 3 | | | | | | | 0 | 7 | 7 | 10 | -3 |
| Chevron type | -2 | 3 | 1 | 3 | 1 | -3 | 3 | -5 | | | | | | | -2 | 10 | 8 | 1 | -4 |

FIG. 4B

107Ib

Table when crossover frequency (fc) = 800 Hz

| Number (i) | Probability for effectiveness (α) | Amount of expected improvement (β) | Average amount of improvement for each speech sound (γ) | | | | | | | | | | |
|---|---|---|---|---|---|---|---|---|---|---|---|---|---|
| | | | a | i | u | e | o | ka | ki | ku | | | po |
| 1 | 64% | +2.9 | 2 | 11 | 14 | 5 | 4 | 13 | 11 | 10 | | | 7 |
| 2 | 0% | 0.0 | -2 | -6 | 0 | 2 | -2 | 3 | 3 | 3 | ●●●●● | | -8 |
| 3 | 20% | +0.3 | 0 | 0 | -2 | -2 | 0 | 1 | 3 | 1 | | | 3 |
| 4 | 25% | +1.3 | 0 | 3 | 0 | 0 | 2 | 0 | -5 | -3 | | | -6 |

Table when crossover frequency (fc) = 1250 Hz

| Number (i) | Probability for effectiveness (α) | Amount of expected improvement (β) | Average amount of improvement for each speech sound (γ) | | | | | | | | | | |
|---|---|---|---|---|---|---|---|---|---|---|---|---|---|
| | | | a | i | u | e | o | ka | ki | ku | | | po |
| 1 | 66% | +3.5 | 4 | 11 | 7 | 5 | 5 | 9 | 11 | 8 | | | 10 |
| 2 | 0% | 0.0 | -2 | 0 | -3 | 1 | 0 | -2 | 0 | 1 | ●●●●● | | -5 |
| 3 | 60% | +1.0 | 0 | 1 | 1 | -2 | 0 | 1 | 2 | 0 | | | 4 |
| 4 | 0% | +0.0 | 0 | 3 | 0 | 0 | 2 | 0 | -5 | -3 | | | -6 |

Table when crossover frequency (fc) = 2000 Hz

| Number (i) | Probability for effectiveness (α) | Amount of expected improvement (β) | Average amount of improvement for each speech sound (γ) | | | | | | | | | | |
|---|---|---|---|---|---|---|---|---|---|---|---|---|---|
| | | | a | i | u | e | o | ka | ki | ku | | | po |
| 1 | 50% | +1.7 | 4 | 7 | 4 | 4 | 4 | 5 | 6 | 3 | | | 1 |
| 2 | 0% | 0.0 | -2 | 0 | -5 | 1 | -2 | 0 | 1 | -2 | ●●●●● | | -10 |
| 3 | 40% | +1.0 | 0 | 1 | 2 | 3 | 0 | 1 | 3 | 6 | | | 0 |
| 4 | 95% | +1.3 | 1 | 2 | 1 | 1 | 3 | 1 | 2 | 1 | | | -1 |

FIG. 7B (a)

| | | | | | | | | | | | | | |
|---|---|---|---|---|---|---|---|---|---|---|---|---|---|
| Response from user | Zi | Ra | Bo | o | Da | Ge | a | Ri | Mo | Te | • | • | • |
| Correct information | Zi | Ra | Ho | o | Wa | e | a | Ni | To | Te | • | • | • |
| Verification result | oo | oo | xo | _o | xo | xo | _o | xo | xo | oo | • | • | • |

(b)

| Phoneme | A | I | U | E | O | K | S | T | N | H | M | Y | R | W | G | Z | D | B | P |
|---|---|---|---|---|---|---|---|---|---|---|---|---|---|---|---|---|---|---|---|
| Accuracy rate for each phoneme (%) | 80 | 50 | 50 | 20 | 70 | 65 | 85 | 30 | 55 | 85 | 60 | 25 | 20 | 30 | 50 | 70 | 15 | 50 | 85 |

(c)

| Phoneme | A | I | U | E | O | K | S | T | N | H | M | Y | R | W | G | Z | D | B | P |
|---|---|---|---|---|---|---|---|---|---|---|---|---|---|---|---|---|---|---|---|
| Accuracy rate below 30% | 0 | 10 | 10 | $\boxed{5}$ | 5 | 10 | 5 | 10 | 0 | 5 | 0 | $\boxed{0}$ | $\boxed{0}$ | 0 | 10 | 5 | $\boxed{10}$ | 10 | 5 |
| Accuracy rate 30 to 80% | 0 | $\boxed{10}$ | $\boxed{10}$ | 5 | $\boxed{5}$ | $\boxed{20}$ | 10 | $\boxed{20}$ | $\boxed{0}$ | 5 | $\boxed{0}$ | 0 | 0 | $\boxed{0}$ | $\boxed{20}$ | $\boxed{10}$ | 20 | $\boxed{20}$ | $\boxed{10}$ |
| Accuracy rate above 80% | $\boxed{0}$ | 5 | 5 | 0 | 0 | 5 | $\boxed{0}$ | 5 | 0 | $\boxed{0}$ | 0 | 0 | 0 | 0 | 5 | 5 | 5 | 5 | 5 |

(d)

| Phoneme | A | I | U | E | O | K | S | T | N | H | M | Y | R | W | G | Z | D | B | P |
|---|---|---|---|---|---|---|---|---|---|---|---|---|---|---|---|---|---|---|---|
| Amount of expected improvement | 0 | 10 | 10 | 5 | 5 | 20 | 0 | 20 | 0 | 0 | 0 | 0 | 0 | 0 | 20 | 10 | 10 | 20 | 10 |

(e)

| | |
|---|---|
| Determination result | Whole |
| Amount of expected improvement | 7.4 |

| Frequency | Hearing level | |
|---|---|---|
| | Left ear | Right ear |
| 125Hz | 30dB | 40dB |
| 250Hz | 30dB | 40dB |
| 500Hz | 40dB | 45dB |
| 1000Hz | 50dB | 60dB |
| 2000Hz | 55dB | 50dB |
| 4000Hz | 60dB | 55dB |
| 8000Hz | 65dB | 50dB |

HEARING ASSISTANCE SUITABILITY DETERMINING DEVICE AND HEARING ASSISTANCE SUITABILITY DETERMINING METHOD

TECHNICAL FIELD

The present invention relates to a hearing assistance suitability determining device and a hearing assistance suitability determining method.

BACKGROUND ART

In recent years, as the aging of society advances, the number of people whose hearing is impaired due to old age is increasing. It is important for the hearing-impaired people to particularly hear words. For this reason, it is believed that the need for hearing aids that allow the hearing-impaired people to hear words will greatly increase.

Examples of a hearing assistance method for increasing clarity of speech to be heard by the hearing-impaired people include dichotic hearing assistance. The dichotic hearing assistance is known to increase the clarity of the speech to be heard by the hearing-impaired people (see Non Patent Literature (NPL) 1, for instance).

Moreover, the inventors have previously disclosed a technique of presenting information as to whether or not dichotic hearing assistance can be applied (Patent Literature (PTL) 1).

CITATION LIST

Patent Literature

[PTL 1]
International Publication WO 2010/146825

Non Patent Literature

[NPL 1]
Y. Suzuki et al. "Determination of filtering parameters for dichotic-listening binaural hearing aids", Acoustic 08 Paris, (France), 2008

SUMMARY OF INVENTION

Technical Problem

However, it is not possible to determine whether or not the hearing-impaired people can clearly hear speech using the dichotic hearing assistance.

The present invention has been conceived in view of such a problem, and an object of the present invention is to provide, for example, a hearing assistance suitability determining device that determines a suitability including information as to whether or not a subject can clearly hear speech using the dichotic hearing assistance.

Solution to Problem

In order to achieve the object, a hearing assistance suitability determining device according to an aspect of the present invention a hearing ability information input unit that receives hearing ability information indicating a hearing ability of a subject for frequencies; a hearing ability type determining unit that determines at least one of hearing ability types that corresponds to the hearing ability information, based on frequency characteristics of the hearing ability information received by the hearing ability information input unit, the hearing ability types each being defined by a tendency in a change of a hearing ability with respect to frequencies; a suitability determining unit that determines a suitability of the subject for dichotic hearing assistance based on the at least one hearing ability type determined by the hearing ability type determining unit; and a suitability presenting unit that presents the suitability determined by the suitability determining unit, wherein the suitability determining unit determines, by referring to a correspondence relationship, the suitability based on an amount of clarity improvement for a speech sound that corresponds to the at least one hearing ability type determined by the hearing ability type determining unit, the correspondence relationship indicating, for each of the hearing ability types, an amount of clarity improvement for a speech sound that is a degree by which a clarity of speech perceived by the subject is improved by the dichotic hearing assistance.

It is to be noted that these general and specific aspects may be implemented using a system, a method, an integrated circuit, a computer program, or a computer-readable recording medium such as a CD-ROM, or any combination of systems, methods, integrated circuits, computer programs, or computer-readable recording media.

Advantageous Effects of Invention

The present invention makes it possible to easily determine a suitability including information as to whether or not a subject can clearly hear speech using the dichotic hearing assistance.

BRIEF DESCRIPTION OF DRAWINGS

FIG. 2B is a diagram showing an exemplary hearing ability type classification algorithm.

FIG. 3A is an exemplary audiogram determined as a high-frequency plunging type.

FIG. 3B is an exemplary audiogram determined as a chevron type.

FIG. 3C is an exemplary audiogram determined as a flat type.

FIG. 4A is a table showing exemplary data in a suitability database.

FIG. 4B is a table showing other exemplary data in a suitability database.

FIG. 7B is a diagram showing, in Embodiment 2, (a) exemplary responses to a speech audiometry test, (b) an exemplary accuracy rate for each phoneme, (c) an exemplary standard for an accuracy rate for each phoneme, (d) an exemplary amount of expected improvement for each phoneme, and (e) an exemplary amount of expected improvement for a subject.

DESCRIPTION OF EMBODIMENTS (Underlying Knowledge Forming Basis of the Present Invention)

In relation to the hearing assistance method described in the Background Art section, the inventors have found the following problems.

A state of hearing impairment differs from hearing-impaired person to hearing-impaired person. Consequently, when the hearing-impaired person wears an off-the-rack hearing aid, the hearing aid does not serve its purpose. In view of the above, when selling hearing aids, it is necessary to measure aural characteristics of hearing-impaired people buying the hearing aids, and set each of the hearing aids according to symptoms of each of the hearing-impaired people.

In the currently most common aural characteristics test, a pure tone is produced using a device called an audiometer, and the minimum sound pressure level (hearing level) at which a subject (hearing-impaired person) can hear is measured.

Figures 9A, 9B:
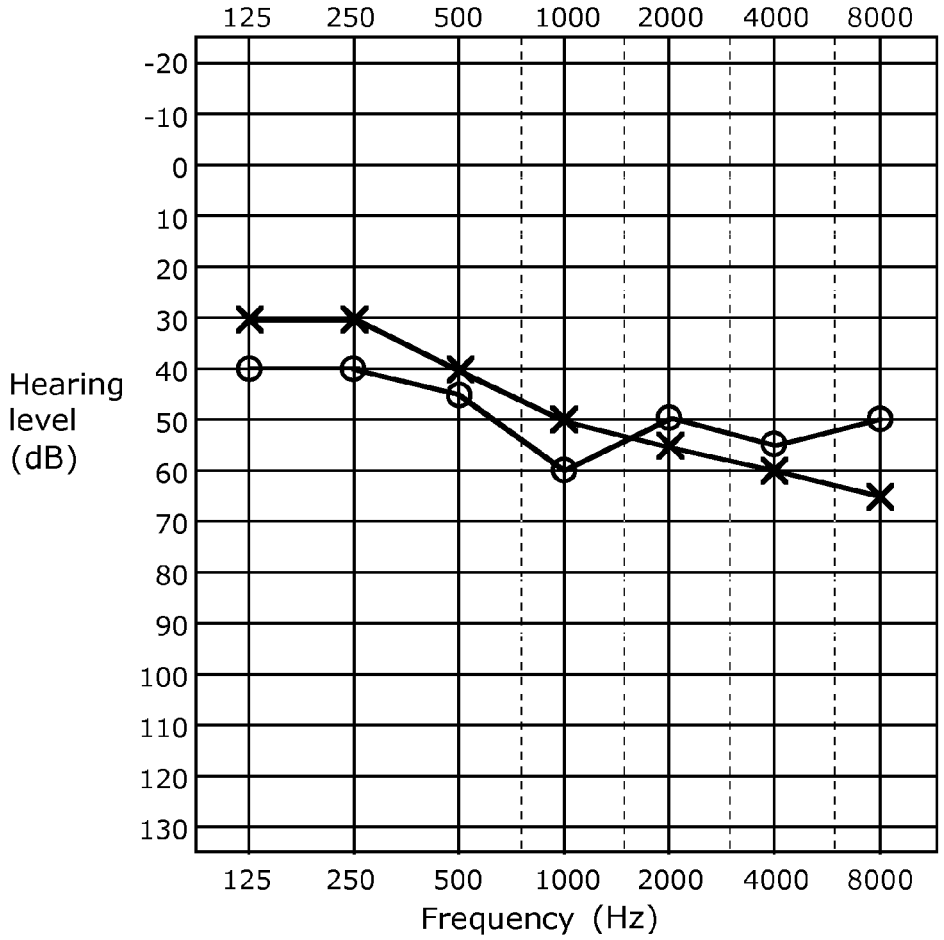
FIG. 9A is an exemplary audiogram.
FIG. 9B is a table showing exemplary input values for a hearing level input unit.

FIG. 9A is an exemplary audiogram.

Generally, the lowest audibility level (hereinafter, referred to as a hearing level) is measured for the respective sinusoidal waves (pure tones) of 125 Hz, 250 Hz, 500 Hz, 1000 Hz, 2000 Hz, 4000 Hz, and 8000 Hz in the aural characteristics test. Here, when necessary, the same measurement may be further performed for 750 Hz, 1500 Hz, 3000 Hz, or 6000 Hz. It is to be noted that a unit of a hearing level is a decibel (dB), and a sound pressure level at which people having a normal hearing ability can hear is 0 dB. A higher hearing level indicates a lower hearing ability. A graph on which hearing levels for respective frequencies are plotted is an audiogram, and is widely used to set the hearing aids.

Figure 8:
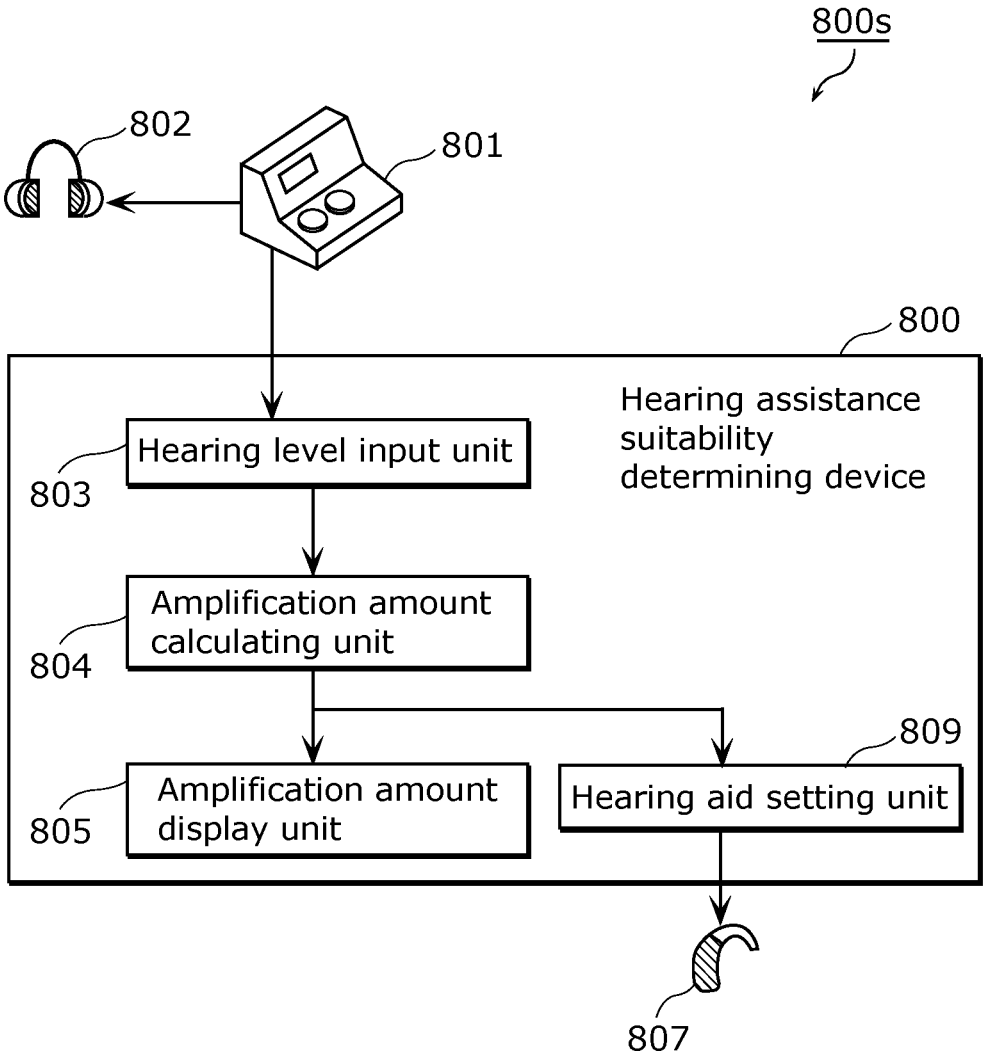
FIG. 8 is a block diagram showing a conventional hearing assistance suitability determining device.

FIG. 8 is a block diagram showing a common hearing aid adjustment system 800*s*.

Conventionally, in the adjustment of a hearing aid, a measuring person presents pure tones produced by an audiometer 801, to a subject through headphones 802, and operates the audiometer 801 when the subject hears measurement tones, to measure hearing levels of the subject.

FIG. 9B is a table showing exemplary input values for a hearing level input unit.

After the measurement of the hearing levels by the audiometer 801 is completed, a hearing assistance suitability determining device 800 (FIG. 8) acquires, through a hearing level input unit 803, the hearing levels for respective frequencies measured by the audiometer 801, as shown in FIG. 9B.

Next, an amplification amount calculating unit 804 calculates, from the acquired hearing levels for the respective frequencies, an amplification amount for compensating hearing impairment of the subject.

An amplification amount display unit 805 notifies the measuring person of the amplification amount, and sets it to an internal parameter of a hearing aid 807 through a hearing aid setting unit 806.

The adjustment for compensation (amplification) according to personal hearing levels is completed through the above procedure.

On the other hand, it is said that a hearing-impaired person has a reduced frequency resolution in addition to the hearing impairment. Here, the frequency resolution is an ability to distinguish two sounds having mutually different frequencies.

In other words, a hearing person can distinguish two sounds having frequencies adjacent to each other such as a sound at 1 kHz and a sound at 1.2 kHz. In comparison, the hearing-impaired person having the reduced frequency resolution is unable to distinguish these two sounds.

In recent year, auditory filtering has been proposed as a model for representing a frequency-analysis mechanism for human hearing. This frequency-analysis mechanism in a human inner ear is represented by an aggregate of band-pass filters (auditory filters) corresponding to divided frequency bands, and it is determined that a frequency resolution has been reduced when a width of an auditory filter is great.

Large reduction in the frequency resolution increases an influence of masking between frequency band components, particularly of masking high-frequency components by low-frequency components (upward masking). Especially in a speech, a vowel having a main component in low frequencies has a large amount of energy, and thus a consonant having a main component in higher frequencies is masked.

This not only reduces the ability to hear words but also significantly diminishes a speech discrimination ability under noise.

The reduction in frequency resolution is a phenomenon based on a principle different from that of the decrease in hearing level. For this reason, the problem cannot be solved by a hearing aid amplifying sound, which poses a significant challenge to the ability of the hearing-impaired people to hear words.

Examples of hearing assistance processing that is intended to increase clarity of audio input signals by reducing such masking between the frequency bands include the dichotic hearing assistance in which an input signal is divided on a frequency axis to be assigned to respective left and right ears of the hearing-impaired person.

Figure 10:
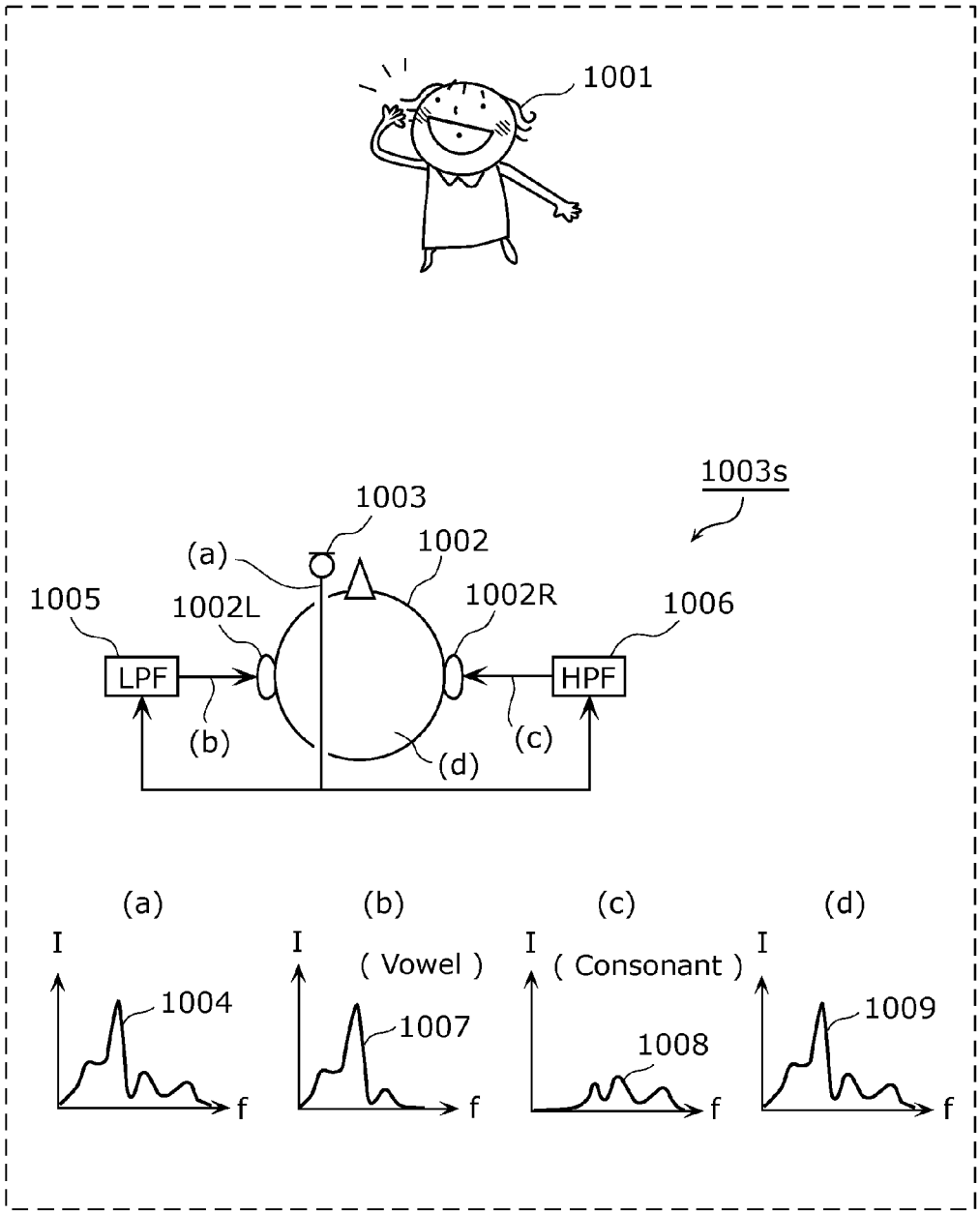
FIG. 10 is a diagram showing operation of dichotic hearing assistance.

FIG. 10 is a diagram showing a hearing assistance adjustment system 1003*s* for the dichotic hearing assistance.

In a situation where a speaker 1001 and a user 1002 talk with each other, a microphone 1003 converts speech of the speaker 1001 into electrical signals.

An input speech signal 1004 (graph (a)) is divided by a low-pass filter 1005 and a high-pass filter 1006, using, as a cut-off frequency, a frequency in a region where auditory filters are placed.

Proposed has been a method for presenting, among speech signals resulting from the division, a speech signal 1007 (graph (b)) having a frequency lower than a crossover frequency, to one of ears (a right ear 1002R), and a speech signal 1008 (graph (c)) having a frequency higher than the crossover frequency, to the other of the ears (a left ear 1002L).

The user 1002 combines the speech signals 1007 and 1008 in the user's head, and perceives speech 1009 (graph (d)).

It has been reported that the system makes it possible to increase clarity of speech by avoiding the upward masking (NPL 1).

Figure 11:
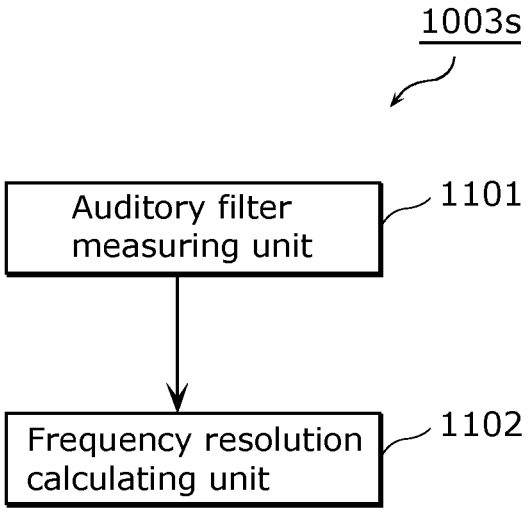
FIG. 11 is a block diagram showing dichotic hearing assistance determination by a conventional technique.

FIG. 11 is a diagram showing a hearing assistance suitability determining method for use in the hearing assistance adjustment system 1003*s*.

As shown in FIG. 11, in the hearing assistance adjustment system 1003*s*, a auditory filter measuring unit 1101 measures an auditory filter, and a frequency resolution calculating unit 1102 determines at which frequency a tone region is divided into a high-tone region and a low-tone region, according to a value obtained from the measurement.

It is known, however, that it is not possible to increase, for all the hearing-impaired people, the clarity of the speech to be heard. To put it another way, cases are reported where some of the hearing-impaired people have not received clarity improvement effects, and it is necessary to determine whether or not such dichotic hearing assistance is recommended for a user, when the dichotic hearing assistance is applied to a hearing aid.

With the conventional technique, in order to determine a suitability for dichotic hearing assistance, it is insufficient to merely measure hearing levels using an audiometer (refer to the above-described audiometer 801), and it is necessary to separately measure frequency resolution of a hearing ability of a user. Since the measurement of the frequency resolution is time-consuming, it is impractical to perform the measurement at a clinical site.

In order to solve the problem, the inventors have previously disclosed a hearing assistance suitability determining device that determines whether or not to apply dichotic hearing assistance, based on a hearing impairment pattern (PTL 1). The hearing assistance suitability determining device disclosed in PTL 1 determines a hearing ability type based on information about a hearing ability of a hearing-impaired person, and statistically determines a suitability for dichotic hearing assistance (a degree of whether or not the hearing-impaired person can clearly hear speech when using the dichotic hearing assistance) based on the determined hearing ability type. However, the assistance suitability determining device does not make it possible to determine whether or not the hearing-impaired person can clearly hear speech using the dichotic hearing assistance.

The present invention has been conceived in view of such a problem, and an object of the present invention is to provide, for example, a hearing assistance suitability determining device that determines a suitability including information as to whether or not a hearing-impaired person (subject) can clearly hear speech using the dichotic hearing assistance.

In order to achieve the object, a hearing assistance suitability determining device according to an aspect of the present invention a hearing ability information input unit configured to receive hearing ability information indicating a hearing ability of a subject for frequencies; a hearing ability type determining unit configured to determine at least one of hearing ability types that corresponds to the hearing ability information, based on frequency characteristics of the hearing ability information received by the hearing ability information input unit, the hearing ability types each being defined by a tendency in a change of a hearing ability with respect to frequencies; a suitability determining unit configured to determine a suitability of the subject for dichotic hearing assistance based on the at least one hearing ability type determined by the hearing ability type determining unit; and a suitability presenting unit configured to present the suitability determined by the suitability determining unit, wherein the suitability determining unit is configured to determine, by referring to a correspondence relationship, the suitability based on an amount of clarity improvement for a speech sound that corresponds to the at least one hearing ability type determined by the hearing ability type determining unit, the correspondence relationship indicating, for each of the hearing ability types, an amount of clarity improvement for a speech sound that is a degree by which a clarity of speech perceived by the subject is improved by the dichotic hearing assistance.

With this, the hearing assistance suitability determining device determines, based on the hearing ability information resulting from an audiometric test on the subject, whether or not the subject can clearly hear, using the dichotic hearing assistance, a speech sound that is a constituent unit of speech. Then, the hearing assistance suitability determining device makes it possible to obtain information as to whether or not the subject can clearly hear the speech using the dichotic hearing assistance, based on the determination result. Thus, the hearing assistance suitability determining device makes it possible to determine the suitability including the information as to whether or not the subject can clearly hear the speech using the dichotic hearing assistance.

Moreover, for instance, the hearing assistance suitability determining device further includes: a speech sound hearing level input unit configured to receive, from the subject, a response to a speech audiometry test; and a phoneme accuracy rate calculating unit configured to calculate a phoneme accuracy rate based on the response received by the speech sound hearing level input unit, the phoneme accuracy rate indicating, for a phoneme that is a unit constituting a speech sound, whether or not the subject has accurately heard a speech sound, wherein the suitability determining unit is configured to determine the suitability based on (i) the amount of clarity improvement for the speech sound that corresponds to the at least one hearing ability type determined by the hearing ability type determining unit and (ii) the phoneme accuracy rate for the phoneme calculated by the phoneme accuracy rate calculating unit.

With this, the hearing assistance suitability determining device makes it possible to properly obtain, based on the subject's responses to the speech audiometry test, the information as to whether or not the subject can clearly hear speech on a phoneme basis using the dichotic hearing assistance. Thus, the hearing assistance suitability determining device makes it possible to more accurately determine the suitability including the information as to whether or not the subject can clearly hear the speech using the dichotic hearing assistance.

Moreover, for example, the suitability determining unit is configured to hold the correspondence relationship for each of crossover frequencies in the dichotic hearing assistance, and determine, among the crossover frequencies, a crossover frequency at which the dichotic hearing assistance is most effective for the subject to accurately hear the speech sound, based on the amount of clarity improvement for the speech sound that corresponds to the at least one hearing ability type determined by the hearing ability type determining unit, and the suitability presenting unit is configured to present the crossover frequency determined by the suitability determining unit, together with the suitability.

With this, the hearing assistance suitability determining device makes it possible to select, from among the candidate crossover frequencies for the dichotic hearing assistance, the crossover frequency at which the dichotic hearing assistance is highly effective for the subject. Thus, the hearing assistance suitability determining device makes it possible to more accurately determine the suitability including the information as to whether or not the subject can clearly hear the speech using the dichotic hearing assistance.

Moreover, for instance, the hearing assistance suitability determining device further includes a hearing assistance process setting unit configured to output, to hearing aids, setting information that allows the hearing aids to provide the subject with the dichotic hearing assistance.

With this, when the suitability of the subject for the dichotic hearing assistance is high, the hearing assistance suitability determining device makes it possible to perform setting that allows the hearing aids of the subject to provide the dichotic hearing assistance.

Moreover, for example, the suitability determining unit is configured to determine, as the suitability, the amount of clarity improvement for the speech sound that corresponds to the at least one hearing ability type determined by the hearing ability type determining unit.

With this, the hearing assistance suitability determining device presents, to the subject, the amount of clarity improvement for each speech sound as the suitability. Consequently, the subject can judge whether or not the dichotic hearing assistance is suitable for the subject, based on the amount of clarity improvement for each speech sound shown by the hearing assistance suitability determining device and a clarity for each speech sound heard by the subject.

Moreover, for instance, the suitability determining unit is configured to determine, as the suitability, an average value of amounts of clarity improvement for respective speech sounds that correspond to the at least one hearing ability type determined by the hearing ability type determining unit.

With this, the hearing assistance suitability determining device presents, to the subject, the average value of the amounts of clarity improvement for the respective speech sounds as the suitability. As a result, the subject can judge whether or not the dichotic hearing assistance is suitable for the subject, based on the average value of the amounts of clarity improvement for the respective speech sounds shown by the hearing assistance suitability determining device and a clarity for each speech sound heard by the subject.

Moreover, for example, the suitability determining unit is configured to determine, as the suitability, the amount of clarity improvement that corresponds to the phoneme accuracy rate for the phoneme calculated by the phoneme accuracy rate calculating unit, for the at least one hearing ability type determined by the hearing ability type determining unit.

With this, the hearing assistance suitability determining device presents, to the subject, the amount of clarity improvement for each phoneme in consideration of the verification information of the speech audiometry test on the subject, as the suitability. The subject can determine whether or not the dichotic hearing assistance is suitable for oneself, based on the amount of clarity improvement.

Moreover, for instance, the suitability determining unit is configured to determine, as the suitability, an average value of amounts of clarity improvement each corresponding to a different one of phoneme accuracy rates for respective phonemes calculated by the phoneme accuracy rate calculating unit, for the at least one hearing ability type determined by the hearing ability type determining unit.

With this, the hearing assistance suitability determining device presents, to the subject, the average value of the amounts of clarity improvement for the respective speech sounds in consideration of the verification information of the speech audiometry test on the subject, as the suitability. The subject can determine whether or not the dichotic hearing assistance is suitable for oneself, based on the average value.

A hearing assistance suitability determining method according to another aspect of the present invention includes: receiving hearing ability information indicating a hearing ability of a subject for frequencies; determining at least one of hearing ability types that corresponds to the hearing ability information, based on frequency characteristics of the hearing ability information received in the receiving, the hearing ability types each being defined by a tendency in a change of a hearing ability with respect to frequencies; determining a suitability of the subject for dichotic hearing assistance based on the at least one hearing ability type determined in the determining of at least one of hearing ability types; and presenting the suitability determined in the determining of a suitability, wherein in the determining of a suitability, by referring to a correspondence relationship, the suitability is determined based on an amount of clarity improvement for a speech sound that corresponds to the at least one hearing ability type determined in the determining of at least one of hearing ability types, the correspondence relationship indicating, for each of the hearing ability types, an amount of clarity improvement for a speech sound that is a degree by which a clarity of speech perceived by the subject is improved by the dichotic hearing assistance.

It is to be noted that these general and specific aspects may be implemented using a system, a method, an integrated circuit, a computer program, or a computer-readable recording medium such as a CD-ROM, or any combination of systems, methods, integrated circuits, computer programs, or computer-readable recording media.

The following describes a hearing assistance suitability determining device according to embodiments of the present invention, with reference to the drawings.

Each of the embodiments described below shows a general or specific example. The numerical values, shapes, materials, structural elements, the arrangement and connection of the structural elements, steps, the processing order of the steps etc. shown in the following embodiments are mere examples, and therefore do not limit the scope of the present invention. Therefore, among the structural elements in the following embodiments, structural elements not recited in any one of the independent claims are described as arbitrary structural elements.

(Embodiment 1)

Figure 1A:
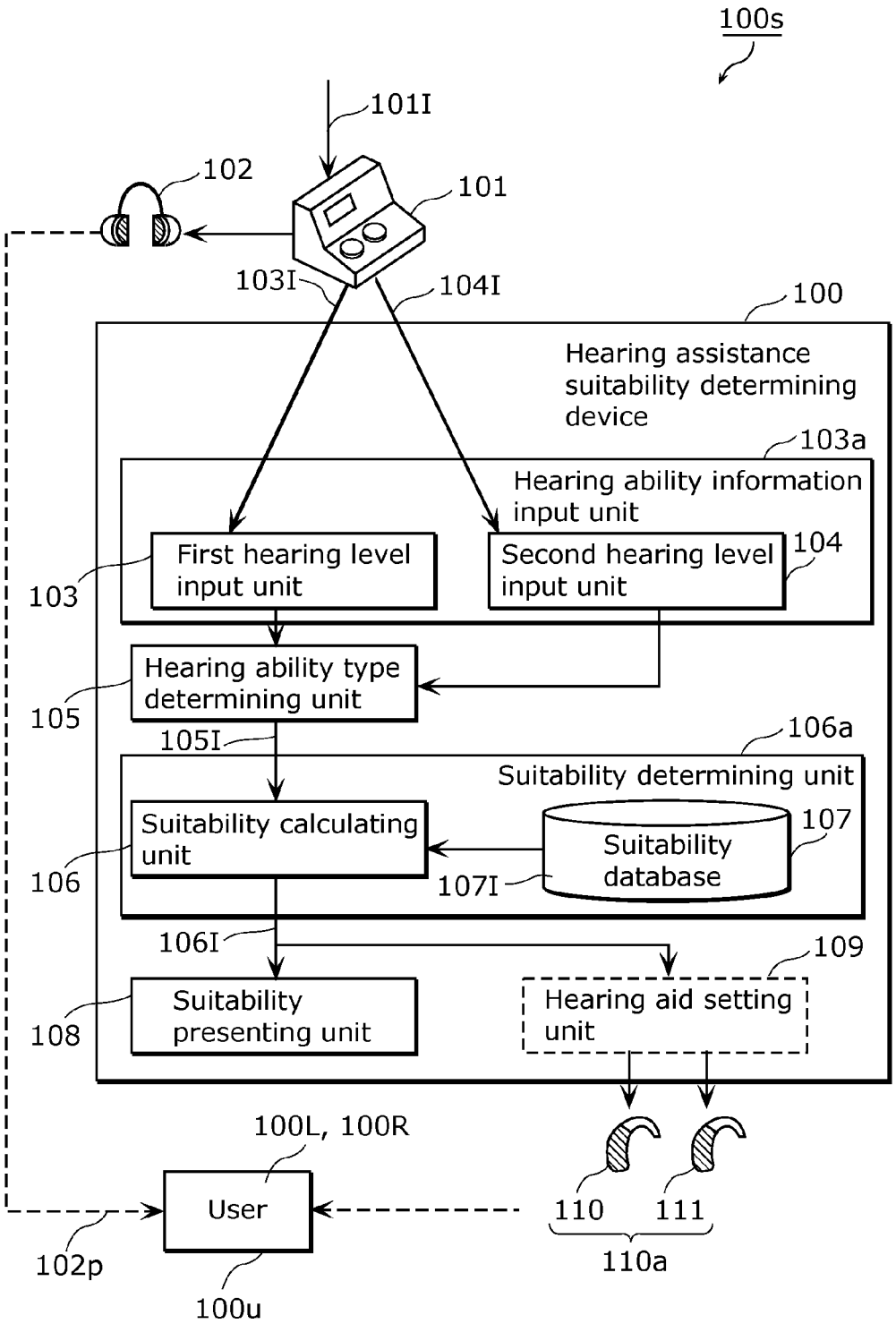
FIG. 1A is a block diagram showing a hearing assistance suitability determining device according to Embodiment 1.

FIG. 1A is a block diagram showing a hearing assistance suitability determining system 100*s* including a hearing assistance suitability determining device 100 according to Embodiment 1 of the present invention.

The hearing assistance suitability determining system 100*s* includes an audiometer 101, headphones 102, and the hearing assistance suitability determining device 100.

The audiometer 101 produces pure tones 102*p*. The pure tones 102*p* are presented to a hearing-aid user (subject) 100*u* through the headphones 102. Information 101I indicating whether or not the subject can hear the presented tones is transmitted to the audiometer 101 by a measuring person or through an interface, and the audiometer 101 that has received the information 101I measures hearing levels.

The hearing assistance suitability determining device 100 adjusts hearing assistance processing in two hearing aids 110*a* including a left-ear hearing aid 110 and a right-ear hearing aid 111, based on the measurement result of the hearing levels by the audiometer 101.

The hearing assistance suitability determining device 100 includes a first hearing level input unit 103, a second hearing level input unit 104, a hearing ability type determining unit 105, a suitability determining unit 106*a*, and a suitability presenting unit 108. The suitability determining unit 106*a* includes a suitability calculating unit 106 and a suitability database 107. The first hearing level input unit 103 and the second hearing level input unit 104 are collectively referred to as a hearing ability information input unit 103*a*.

It is to be noted that the hearing assistance suitability determining device 100 may further include a hearing aid setting unit 109.

The first hearing level input unit 103 receives a hearing level 103I of one of the ears (e.g., the left ear) of the subject.

The second hearing level input unit 104 receives a hearing level 104I of the other of the ears (e.g., the right ear) of the subject.

The hearing ability type determining unit 105 determines, based on frequency characteristics of hearing levels of the subject, a hearing ability type of the hearing-aid user as at least one of hearing ability types each defined by a tendency in a change of (a pattern of variation in) a hearing ability with respect to frequencies.

The suitability database 107 is a database in which a suitability for dichotic hearing assistance is described for each of the hearing ability types.

The suitability calculating unit 106 extracts, from the suitability database 107, suitability information corresponding to the hearing ability type of the subject.

The suitability presenting unit 108 presents the suitability to the subject.

The hearing aid setting unit 109 sets hearing-aid setting information to the hearing aids of the subject.

The following describes a signal flow in the hearing assistance suitability determining device 100.

The first hearing level input unit 103 receives, from the audiometer 101, hearing levels of one of the left and right ears of the subject, and the second hearing level input unit 104 receives, from the audiometer 101, hearing levels of the other of the left and right ears.

The hearing ability type determining unit 105 receives outputs from each of the first hearing level input unit 103 and the second hearing level input unit 104.

The suitability calculating unit 106 receives outputs (information 105I) from the hearing ability type determining unit 105.

In addition, the suitability calculating unit 106 refers to information described in the suitability database 107 (information 107I).

The suitability presenting unit 108 and the hearing aid setting unit 109 receive outputs (information 106I) from the suitability calculating unit 106.

The left-ear hearing aid 110 and the right-ear hearing aid 111 receive outputs from the hearing aid setting unit 109.

Figure 1B:
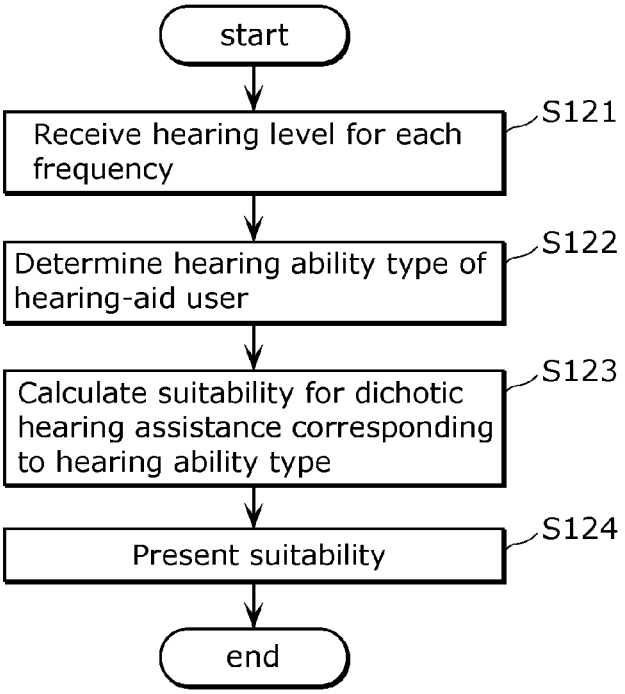
FIG. 1B is a flow chart showing operation of the hearing assistance suitability determining device according to Embodiment 1.

FIG. 1B is a flow chart showing operation of the hearing assistance suitability determining device 100 according to Embodiment 1. The following describes operation of the hearing assistance suitability determining device 100 with reference to FIG. 1B.

First, the first hearing level input unit 103 receives hearing levels of one of the left and right ears for respective frequencies (information 103I), and the second hearing level input unit 104 receives hearing levels of the other of the left and right ears for respective frequencies (information 104I) (step S121).

Next, the hearing ability type determining unit 105 determines, based on a general form of frequency characteristics of the hearing levels of the left and right ears, a hearing ability type of the subject as at least one of hearing ability types each defined by a tendency in a change of a hearing ability with respect to frequencies (step S122).

The determination is performed, for instance, in the following manner.

Figure 2A:
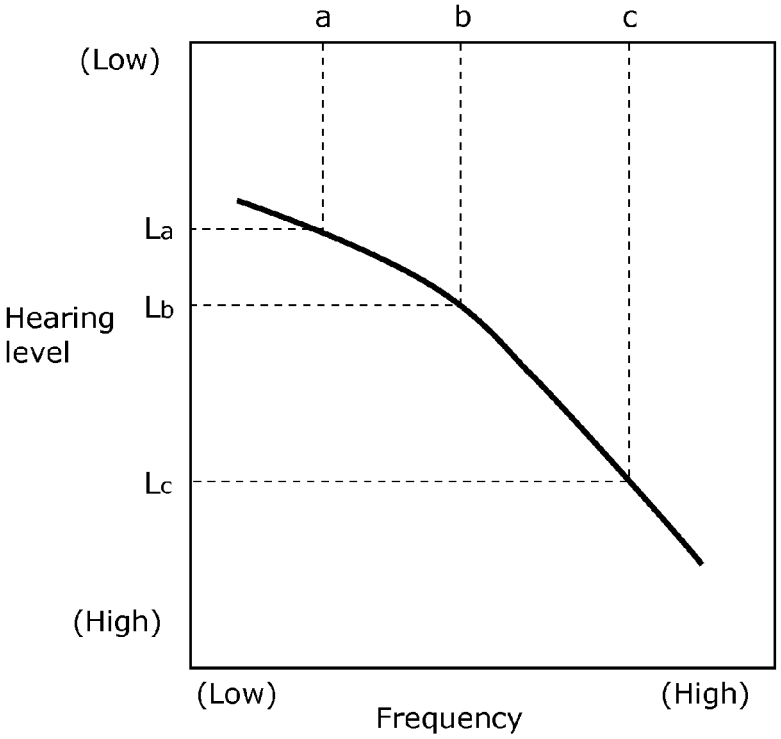
FIG. 2A is a graph showing exemplary hearing levels.

FIG. 2A is a graph showing exemplary hearing levels when average values of hearing levels of the left and right ears for three frequencies a, b, and c (where a<b<c) are expressed as La, Lb, and Lc, respectively.

The horizontal axis of the graph in FIG. 2A represents a frequency, and indicates a higher frequency toward its right end.

The vertical axis represents a hearing level, and indicates a higher level, that is, greater hearing impairment, toward its bottom end.

FIG. 2B is a diagram showing an exemplary hearing ability type classification algorithm.

As shown in FIG. 2B, the hearing ability type determining unit 105 determines the hearing ability type of the subject as a high-frequency sloping type when La<Lb<Lc.

However, the hearing ability type determining unit 105 determines the hearing ability type of the subject as a high-frequency plunging type when La≤Lb<<Lc, that is, instead of a hearing level difference in a range having a relatively low frequency (frequencies a and b), a hearing level difference in a range having a relatively high frequency (frequency c) is above a certain level.

The hearing ability type determining unit 105 determines the hearing ability type of the subject as a chevron type when La<Lb>Lc.

The hearing ability type determining unit 105 determines the hearing ability type of the subject as a flat type when La≈Lb≈Lc.

It is to be noted that although the hearing ability type determining unit 105 performs the determination using the average values of the hearing levels of the left and right ears, to comprehensively determine the hearing levels of the left and right ears, the hearing ability type determining unit 105 may use, among the hearing levels of the left and right ears, the hearing levels of one of the left and right ears which has less hearing-impairment.

Moreover, as a specific example, it is also possible to perform the determination using, for example, the following algorithm.

FIG. 3A is an exemplary audiogram determined as a high-frequency plunging type. FIG. 3B is an exemplary audiogram determined as a chevron type. FIG. 3C is an exemplary audiogram determined as a flat type.

(1) As shown in FIG. 3A, when frequencies of 1 kHz, 2 kHz, and 4 kHz include the following frequency, the hearing ability type determining unit 105 performs the determination in the following manner. In other words, the hearing ability type determining unit 105 determines the hearing ability type of the subject as the high-frequency plunging type, when a hearing level (302) of a frequency (303) is greater (is shown below in FIG. 3A) than a value obtained by adding a predetermined value (e.g., 30 dB) to a hearing level threshold value (301) of a frequency lower than the frequency (303) by 1 octave.

(2) As shown in FIG. 3B, the hearing ability type determining unit 105 determines the hearing ability type of the subject as the chevron type, when a hearing level of each of 500 Hz, 1 kHz, and 2 kHz is less than a value obtained by subtracting a predetermined value (e.g., 10 dB) from a hearing level threshold value of a frequency lower than a frequency (311) by 1 octave.

(3) As shown in FIG. 3C, the hearing ability type determining unit 105 determines the hearing ability type of the subject as the flat type, when a difference (321) between the maximum value and the minimum value of the hearing level threshold value is less than a predetermined value (e.g., 30 dB).

(4) The hearing ability type determining unit 105 determines the hearing ability type of the subject as the high-frequency sloping type, when none of (1), (2), and (3) is applicable.

As stated above, the hearing ability type determining unit 105 shown in FIG. 1A determines, based on the general form of the frequency characteristics of the hearing levels, the hearing ability type of the user 100*u* as one of the hearing ability types that corresponds to the general form, and outputs information (the information 105I shown in FIG. 1A) about the determined hearing ability type to the suitability calculating unit 106.

The suitability calculating unit 106 calculates, by referring to the suitability database 107, a suitability for dichotic hearing assistance corresponding to the hearing ability type determined by the hearing ability type determining unit 105 (step S123).

FIG. 4A is an exemplary suitability database 107.

An expectation value (e.g., "4" in the second row and the second column (107*m*)) of a clarity improvement effect for each speech sound (refer to the second column, the third column . . . ) provided by dichotic hearing assistance is accumulated, for each of hearing ability types (refer to the second to the fifth rows in FIG. 4A) obtained through experiments, as information obtainable by referring to a table (information 107Ia) in the suitability database 107. Here, the expectation value of the clarity improvement effect is shown as a unit of points denoting a difference in percentage (%). It is to be noted that the information 107I in FIG. 1A may be the information 107Ia, for instance. Here, the speech sounds are speech that forms words, and denote sounds composed of vowels, consonants, or a combination of the vowels and consonants.

Furthermore, as shown in FIG. 4B, the suitability database 107 may include tables. Among the tables, a table to be referred to may be switched, for each of crossover frequencies for dichotic hearing assistance, to a table corresponding to the crossover frequency, and the switched table may be referred to. It is to be noted that the information 107I in FIG. 1A may be information 107Ib including the tables.

Moreover, as shown in FIG. 4A, a speech sound may be described for each of phonemes (vowels and consonants) in each of the tables. In addition, as shown in FIG. 4B, each speech sound may be described according to the Japanese syllabary or for each frequency for dichotic hearing assistance in each table.

Furthermore, in the suitability database, different tables to be referred to may be selected from among the tables depending on languages in use or races of patients. In addition, the suitability database may be created by adding, to a basic database, adjustment data with which values of a table are adjusted according to destinations.

The suitability calculating unit 106 refers to an amount of expected improvement y (e.g., 107*m* shown in FIG. 4A) for each speech sound accumulated in the suitability database 107, using the hearing ability type (the information 105I) determined by the hearing ability type determining unit 105 as a key.

Next, the suitability presenting unit 108 presents the suitability to the user of the hearing assistance suitability determining device 100 (step S124). Various methods of presenting a suitability are available. For example, the suitability may be presented by displaying information on a screen of a computer or the like. Moreover, the suitability may be presented using lighting-up of a light emitting diode (LED) or the like. Other methods that make it possible to present a suitability in one way or another may suffice.

Figure 5A:
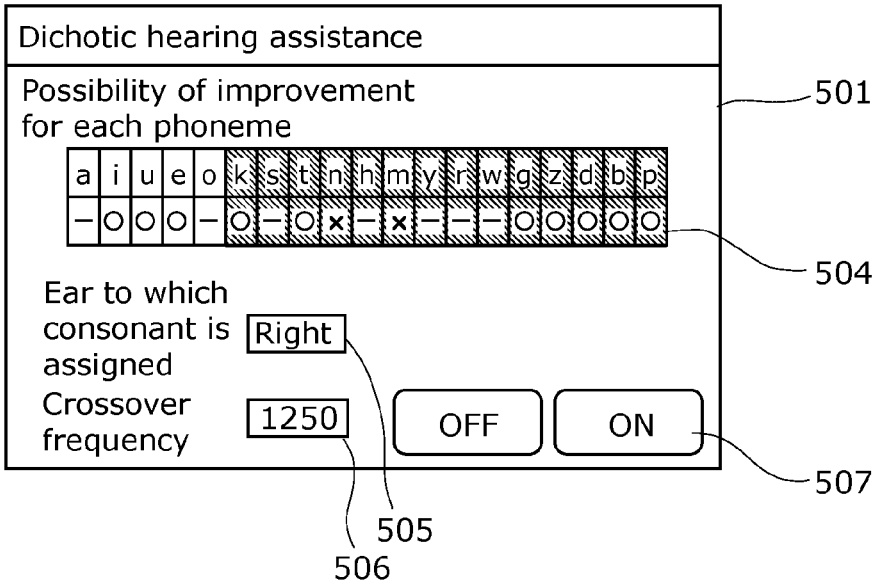
FIG. 5A is a diagram showing an exemplary suitability display screen.

FIG. 5A is a diagram showing an exemplary suitability display screen.

In an example shown in FIG. 5A, an average amount of improvement for each phoneme (an amount of improvement display unit for each phoneme) 504 is displayed in a symbol on the screen 501. In other words, the suitability presenting unit 108 displays "O" when the average amount of improvement for each speech sound is greater than 5%, "–" when the average amount of improvement for each speech sound is between –5% and 5% inclusive, and "X" when the average amount of improvement for each speech sound is less than –5%. It is to be noted that instead of displaying in the symbols, the amounts of improvement may be displayed in different colors or values.

Although the average amount of improvement for each phoneme is displayed in FIG. 5A, an average amount of improvement for each speech sound may be displayed.

Moreover, to address a case where the left and right ears have different hearing ability types, an input space 505 for inputting whether a high tone region is assigned to the left ear or the right ear may be provided to the screen 501. When it is predictable whether the high tone region should be assigned to the left ear or the right ear based on the hearing ability information of the subject, the suitability presenting unit 108 may display the prediction result as an initial value of the input space 505. Furthermore, an input space 506 for inputting a crossover frequency may be provided to the screen 501. When it is possible to predict, based on the hearing ability information of the subject, a high crossover frequency at which an amount of improvement is largest, the suitability presenting unit 108 may display the prediction result as an initial value of the input space 506. Moreover, when a table that shows a clarity improvement effect for each crossover frequency is included, the suitability presenting unit 108 may display, in a given space or the input space 506, a high crossover frequency at which a clarity improvement effect is greatest for the subject. Here, instead of the high crossover frequency at which the clarity improvement effect is greatest, a given crossover frequency may be selected from among crossover frequencies at which clarity improvement effects are better than a predetermined clarity improvement effect.

Furthermore, an interface such as a button 507 may be provided so that the user of the hearing assistance suitability determining device 100 can determine whether or not to finally use the dichotic hearing assistance. When the button 507 is pressed, the hearing aid setting unit 109 sets setting information to the hearing aids.

Here, the suitability presenting unit itself may serve as the interface, and a display color of the suitability presenting unit may be changed by the operation of the interface. It is to be noted that a configuration of the interface is not limited to the button and may be an icon or a slide bar.

Figure 5B:
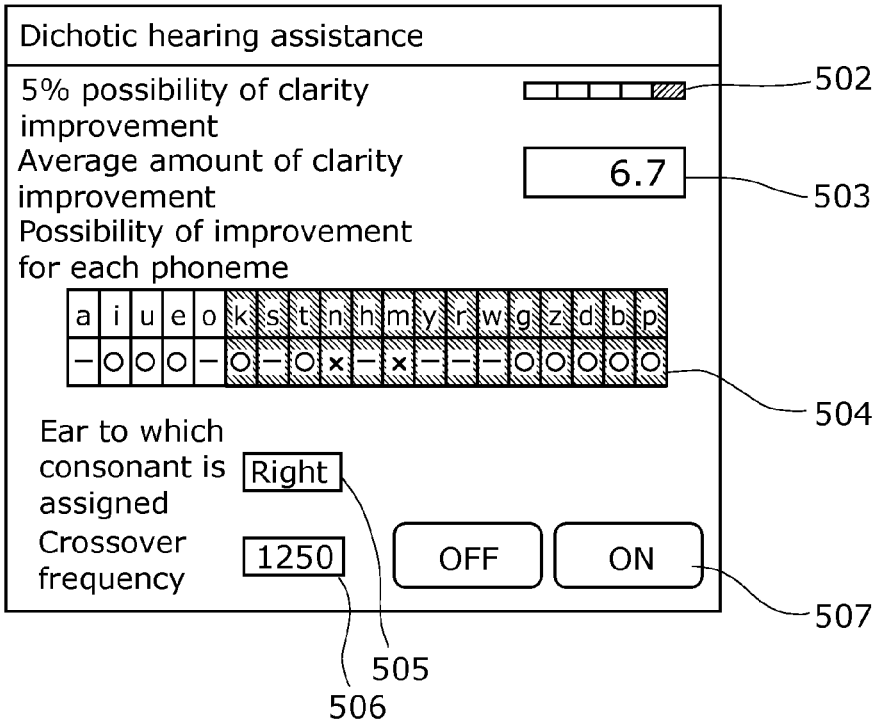
FIG. 5B is a diagram showing another exemplary suitability display screen.

Moreover, as shown in FIG. 5B, an overall possibility of clarity improvement 502 or an amount of expected clarity improvement 503 may be displayed in addition.

As stated above, according to this embodiment, just measuring the hearing levels makes it possible to determine whether or not the dichotic hearing assistance is suitable for the user, and to set the hearing aids.

Moreover, as another aspect of this embodiment, when the hearing ability type of the subject is already known such as when the subject buys new hearing aids, the hearing ability type may be inputted to the suitability calculating unit 106 without going through the first hearing level input unit 103, the second hearing level input unit 104, and the hearing ability type determining unit 105.

Alternatively, instead of explicitly providing the first hearing level input unit 103 and the second hearing level input unit 104, the audiometer 101 and the hearing assistance suitability determining device 100 may integrally measure hearing levels, and use the measurement result as an input value.

Alternatively, when the frequency characteristics of the hearing levels of the left and right ears are similar to each other, only the hearing levels of either the left or right ear may be used as an input value.

Although the hearing assistance suitability determining device and the hearing assistance suitability determining method for determining a suitability for hearing aids have been described above, the present invention is not limited to these and enables similar determination and setting in other audio equipment.

As described above, the hearing assistance suitability determining device according to this embodiment determines, based on hearing ability information resulting from an audiometric test on the subject, whether or not the subject can clearly hear, using the dichotic hearing assistance, a speech sound that is a constituent unit of speech. Then, the hearing assistance suitability determining device makes it possible to obtain information as to whether or not the subject can clearly hear the speech using the dichotic hearing assistance, based on the determination result. Thus, the hearing assistance suitability determining device makes it possible to determine a suitability including the information as to whether or not the subject can clearly hear the speech using the dichotic hearing assistance.

Moreover, the hearing assistance suitability determining device makes it possible to select, from among candidate crossover frequencies for the dichotic hearing assistance, a crossover frequency at which the dichotic hearing assistance is highly effective for the subject. Thus, the hearing assistance suitability determining device makes it possible to more accurately determine the suitability including the information as to whether or not the subject can clearly hear the speech using the dichotic hearing assistance.

Furthermore, when a suitability of the subject for the dichotic hearing assistance is high, the hearing assistance suitability determining device makes it possible to perform setting that allows the hearing aids of the subject to provide the dichotic hearing assistance.

Moreover, the hearing assistance suitability determining device presents, to the subject, an amount of clarity improvement for each speech sound as a suitability. Consequently, the subject can judge whether or not the dichotic hearing assistance is suitable for the subject, based on the amount of clarity improvement for each speech sound shown by the hearing assistance suitability determining device and a clarity for each speech sound heard by the subject.

Furthermore, the hearing assistance suitability determining device presents, to the subject, an average value of amounts of clarity improvement for respective speech sounds as a suitability. As a result, the subject can judge whether or not the dichotic hearing assistance is suitable for the subject, based on the average value of the amounts of clarity improvement for the respective speech sounds shown by the hearing assistance suitability determining device and a clarity for each speech sound heard by the subject.

(Embodiment 2)

Embodiment 2 describes an exemplary hearing assistance suitability determining device that presents, based on a result of a speech audiometry test on a subject, an amount of expected improvement when the subject uses dichotic hearing assistance. It is to be noted that a speech sound is a vowel, a consonant, or a unit of language formed by combining the vowel and the consonant. The speech sound is expressed as, for instance, "Zi," "Ra," or "o." It is also to be noted that a phoneme means each vowel or each consonant. The phoneme is expressed as, for example, "A," "I," "U," "K," or "S." Here, the speech audiometry test is a test for measuring how much the subject can hear a word.

Figure 6:
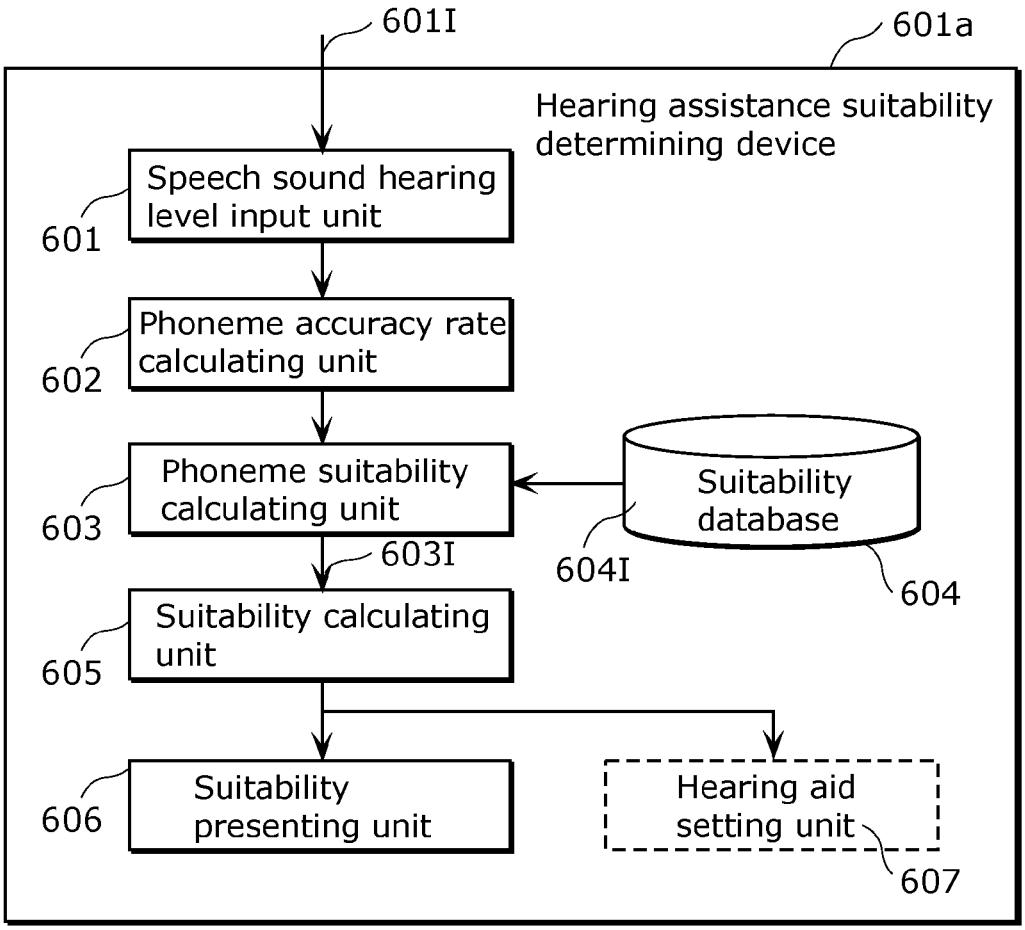
FIG. 6 is a block diagram showing a hearing assistance suitability determining device according to Embodiment 2.

FIG. 6 is a block diagram showing a hearing assistance suitability determining device 601*a* according to Embodiment 2 of the present invention.

In FIG. 6, the hearing assistance suitability determining device 601*a* according to this embodiment includes a speech sound hearing level input unit 601, a phoneme accuracy rate calculating unit 602, a phoneme suitability calculating unit 603, a suitability database 604, a suitability calculating unit 605, a suitability presenting unit 606, and a hearing aid setting unit 607.

The speech sound hearing level input unit 601 receives, from the subject, responses to the speech audiometry test.

The phoneme accuracy rate calculating unit 602 verifies the subject's responses to the speech audiometry test, and calculates an accuracy rate for each phoneme.

The phoneme suitability calculating unit 603 determines a suitability for dichotic hearing assistance based on the accuracy rates for the respective phonemes.

A suitability for dichotic hearing assistance is described for each hearing ability type in the suitability database 604.

The suitability calculating unit 606 extracts, from the suitability database 604, suitability information corresponding to the hearing ability type of the subject.

The suitability presenting unit 606 presents the suitability information.

The hearing aid setting unit 607 sets the suitability information to the hearing aids of the subject.

The following describes a signal flow in the hearing assistance suitability determining device 601*a*.

The speech sound hearing level input unit 601 receives, from the subject, responses to a speech audiometry test (information 601I).

The phoneme accuracy rate calculating unit 602 receives outputs from the speech sound hearing level input unit 601, and the phoneme suitability calculating unit 603 receives outputs from the phoneme accuracy rate calculating unit 602. Moreover, the phoneme suitability calculating unit 603 refers to information (information 604I) described in the suitability database 604. The suitability calculating unit 605 receives outputs (information 603I) from the phoneme suitability calculating unit 603, and the suitability presenting unit 606 and the hearing aid setting unit 607 receive outputs from the suitability calculating unit 605. A left-ear hearing aid 110 and a right-ear hearing aid 111 receive outputs from the hearing aid setting unit 607.

Figure 7A:
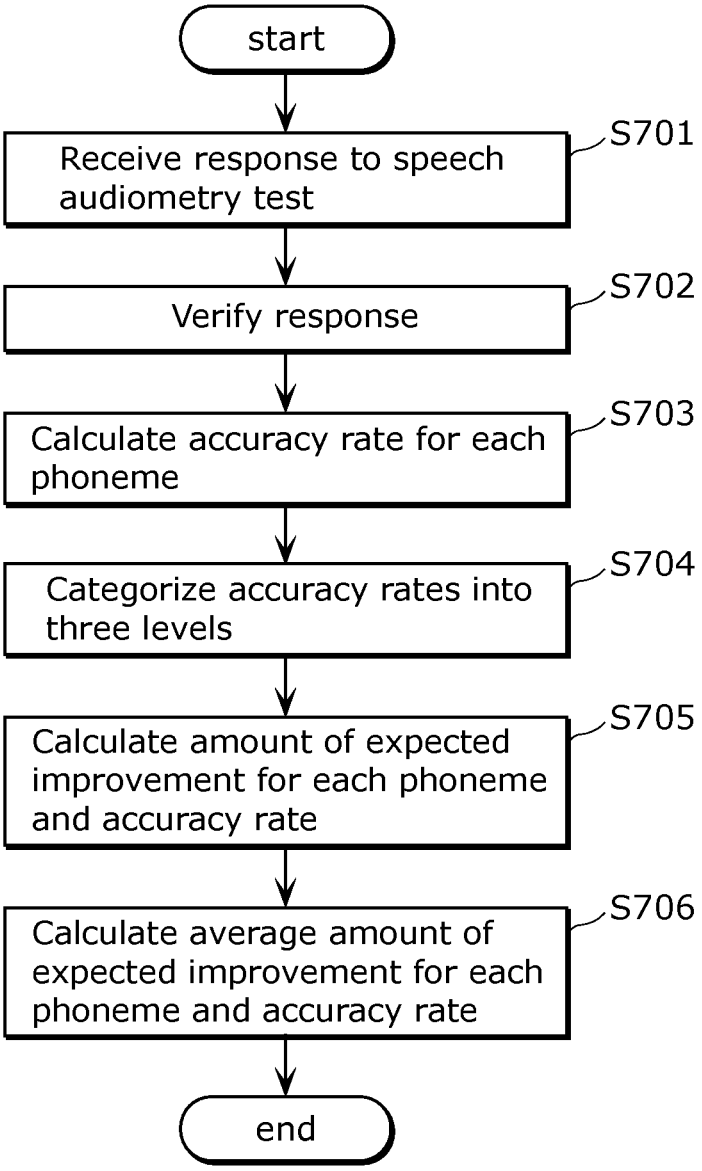
FIG. 7A is a flow chart showing operation of the hearing assistance suitability determining device according to Embodiment 2.

The following describes operation of the hearing assistance suitability determining device 601*a* with reference to FIGS. 7A and 7B. FIG. 7A is a flow chart showing operation of the hearing assistance suitability determining device according to this embodiment. FIG. 7B is a diagram showing, in this embodiment, (a) exemplary responses to a speech audiometry test, (b) an exemplary accuracy rate for each phoneme, (c) an exemplary standard for an accuracy rate for each phoneme, (d) an exemplary amount of expected improvement for each phoneme, and (e) an exemplary amount of expected improvement for a subject.

First, the speech sound hearing level input unit 601 receives, from the subject, responses to a speech audiometry test (S701 in FIG. 7A). Here, as shown in (a) in FIG. 7B, the speech sound hearing level input unit 601 associates correct information for the speech audiometry test and the subject's responses with each other.

Next, the phoneme accuracy rate calculating unit 602 verifies the responses received in step S701 (S702 in FIG. 7A).

The phoneme accuracy rate calculating unit 602 performs the verification for each phoneme by comparing the correct information for the speech audiometry test and the subject's responses. As shown in (a) in FIG. 7B, the phoneme accuracy rate calculating unit 602 performs the verification for a consonant and a vowel of each speech sound, based on a response received from the subject by the speech sound hearing level input unit 601 (e.g., the second "Ra" from the far left) and correct information for the speech audiometry test (information 601Ix, e.g., the second "Ra"). In an example shown in (a) in FIG. 7B, a circle ("O") indicates a correct response, a cross ("X") indicates an incorrect response, and an underbar ("_") indicates that no corresponding consonant is present.

Next, the phoneme suitability calculating unit 603 calculates an accuracy rate for each phoneme based on the verification performed in step S702 (S703 in FIG. 7A). As shown in (b) in FIG. 7B, the phoneme suitability calculating unit 603 tallies, as an accuracy rate for each phoneme, a ratio between the number of correct responses to each phoneme and the number of occurrences of each phoneme in the correct information shown in (a) in FIG. 7B.

Next, the phoneme suitability calculating unit 603 categorizes the accuracy rate for each phoneme calculated in step S703 into one of three levels (S704 in FIG. 7A). As shown in (c) in FIG. 7B, the suitability database 604 accumulates an expected value of a clarity improvement effect for each phoneme by the dichotic hearing assistance which is previously obtained through experiment. Specifically, the suitability database 604 accumulates an expected value of a clarity improvement effect for each phoneme, for each of a level at which a phoneme can be hardly distinguished, a level at which hearing impairment occurs, and a level at which almost normal hearing is present (e.g., a level at which the accuracy rate for the phoneme is below 30%, a level at which the accuracy rate for the phoneme is from 30% to 80%, and a level at which the accuracy rate for the phoneme is above 80%), according to the accuracy rate for the phoneme. Here, the expectation value of the clarity improvement effect is shown as a unit of points denoting a difference in percentage (%). It is to be noted that although the three levels are used for the accuracy rates above, the number of levels is not limited to 3 and may be a given number greater than or equal to 2.

Next, the suitability calculating unit 605 calculates an amount of expected improvement for each level of the accuracy rate for the phoneme categorized in step S704 (S705 in FIG. 7A). The suitability calculating unit 605 calculates an amount of clarity improvement for each phoneme corresponding to one of the levels of the accuracy rates for the phonemes, as an amount of clarity improvement for the phoneme ((d) in FIG. 7B). Specifically, for instance, for a subject whose accuracy rate for a phoneme "A" is 80%, since an amount of clarity improvement corresponding to a level at which an accuracy rate for the phoneme "A" is above 80% is 0 points, the amount of clarity improvement for the phoneme "A" is calculated as 0 points. Moreover, for a subject whose accuracy rate for a phoneme "K" is 65%, since an amount of clarity improvement corresponding to a level at which the an accuracy rate for the phoneme "K" is from 30% to 80% is 20 points, the amount of clarity improvement for the phoneme "K" is calculated as 20 points.

Next, the suitability calculating unit 605 calculates an amount of expected improvement when the subject uses the dichotic hearing assistance (S706 in FIG. 7A). The suitability calculating unit 605 calculates, as the amount of expected improvement when the subject uses the dichotic hearing assistance, an average value of the amounts of expected improvement for the respective phonemes shown in (d) in FIG. 7B. The suitability presenting unit 606 displays the amount of expected improvement.

With this process flow, it is possible to present whether the dichotic hearing assistance allows a user to easily hear a speech sound the user has had difficulty hearing (how the ease of hearing changes).

Moreover, not only the amount of expected improvement for each phoneme is displayed, but also an amount of expected improvement for a phoneme having the lowest accuracy rate in (b) in FIG. 7B may be displayed as a representative value.

Although the hearing assistance suitability determining device and the hearing assistance suitability determining method for determining the suitability for the hearing aids have been described above, the present invention is not limited to these and enables similar determination and setting in other audio equipment.

As described above, the hearing assistance suitability determining device according to this embodiment makes it possible to properly obtain, based on the subject's responses to the speech audiometry test, information as to whether or not the subject can clearly hear speech on a phoneme basis using the dichotic hearing assistance. Thus, the hearing assistance suitability determining device makes it possible to more accurately determine the suitability including the information as to whether or not the subject can clearly hear the speech using the dichotic hearing assistance.

Moreover, the hearing assistance suitability determining device presents, to the subject, the amount of clarity improvement for each phoneme in consideration of the verification information of the speech audiometry test on the subject, as the suitability. The subject can determine whether or not the dichotic hearing assistance is suitable for oneself, based on the amount of clarity improvement.

Moreover, the hearing assistance suitability determining device presents, to the subject, the average value of the amounts of clarity improvement for the respective phonemes in consideration of the verification information of the speech audiometry test on the subject, as the suitability. The subject can determine whether or not the dichotic hearing assistance is suitable for oneself, based on the average value.

(Other Modifications)

It is to be noted that the present invention has been thus far described based on the above embodiments, the present invention is certainly not limited to embodiments. The scope of the present invention includes the following cases.

(1) Each of the above devices is, specifically, a computer system that includes a microprocessor, a ROM, a RAM, a hard disk unit, a display unit, a keyboard, a mouse, and the like. A computer program is stored in the RAM or the hard disk unit. Functions of each of the devices can be achieved by the microprocessor operating in accordance with the computer program. The computer program mentioned here is a combination of a plurality of instruction codes that represent instructions to a computer for achieving predetermined functions.

(2) Part or all of the structural elements included in each of the above devices may be provided in one system LSI (Large Scale Integration). The system LSI is an ultra-multifunctional LSI produced by integrating a plurality of components on one chip, and is, specifically, a computer system that includes a microprocessor, a ROM, a RAM, and the like. A computer program is stored in the RAM. Functions of the system LSI can be achieved by the microprocessor operating in accordance with the computer program.

(3) Part or all of the structural elements included in each of the above devices may be provided in an IC card or a single module that is removably connectable to the device. The IC card or the module is a computer system that includes a microprocessor, a ROM, a RAM, and the like. The IC card or the module may include the above-mentioned ultra-multi-functional LSI. Functions of the IC card or the module can be achieved by the microprocessor operating in accordance with the computer program. The IC card or the module may be tamper resistant.

(4) The present invention may also be the method described above. The present invention may also be a computer program that realizes the method by a computer, or a digital signal including the computer program.

The present invention may also be a computer-readable recording medium on which the computer program or the digital signal is recorded. Examples of the computer-readable recording medium include a flexible disk, a hard disk, a CD-ROM, an MO, a DVD, a DVD-ROM, a DVD-RAM, a BD (Blu-ray Disc), and a semiconductor memory. In addition, the present invention may be the digital signal recorded on such a recording medium.

The present invention may also be the computer program or the digital signal transmitted via an electric communication line, a wired or wireless communication line, a network, such as the Internet, data broadcasting, and the like.

The present invention may also be a computer system that includes a microprocessor and a memory. In this case, the computer program may be stored in the memory, and the microprocessor may operate in accordance with the computer program.

The computer program or the digital signal may be provided to another independent computer system by distributing the recording medium on which the computer program or the digital signal is recorded, or by transmitting the computer program or the digital signal via the network and the like. The independent computer system may then execute the computer program or the digital signal to function.

(5) The above embodiments and modifications may be combined with each other.

Each of the structural elements in each of the above-described embodiments may be configured in the form of an exclusive hardware product, or may be realized by executing a software program suitable for the structural element. Each of the structural elements may be realized by means of a program executing unit, such as a CPU and a processor, reading and executing the software program recorded on a recording medium such as a hard disk or a semiconductor memory. Here, the software program for realizing the hearing assistance suitability determining device according to each of the embodiments is a program described below.

Specifically, the program causes a computer to execute: receiving hearing ability information indicating a hearing ability of a subject for frequencies; determining at least one of hearing ability types that corresponds to the hearing ability information, based on frequency characteristics of the hearing ability information received in the receiving, the hearing ability types each being defined by a tendency in a change of a hearing ability with respect to frequencies; determining a suitability of the subject for dichotic hearing assistance based on the at least one hearing ability type determined in the determining of at least one of hearing ability types; and presenting the suitability determined in the determining of a suitability, wherein in the determining of a suitability, by referring to a correspondence relationship, the suitability is determined based on an amount of clarity improvement for a speech sound that corresponds to the at least one hearing ability type determined in the determining of at least one of hearing ability types, the correspondence relationship indicating, for each of the hearing ability types, an amount of clarity improvement for a speech sound that is a degree by which a clarity of speech perceived by the subject is improved by the dichotic hearing assistance.

Although the hearing assistance suitability determining device according to one or more of the aspects of the present invention has been thus far described based on the embodiments, the present invention is not limited to the embodiments. Various modifications of the embodiments as well as embodiments resulting from combining structural elements of different embodiments that may be conceived by those skilled in the art may also be included within the scope according to one or more of the aspects of the present invention as long as these do not depart from the spirit of the present invention.

INDUSTRIAL APPLICABILITY

A hearing assistance suitability determining device and a hearing assistance suitability determining method produce an advantageous effect of easily performing determination of a suitability for dichotic hearing assistance and setting to hearing aids, and are useful for general devices that perform speech reproduction or allow verbal communication such as hearing aids, audio equipment, mobile phones, and loudspeakers.

REFERENCE SIGNS LIST

100, 601*a*, 800 Hearing assistance suitability determining device
100*s*, 800*s*, 1000*s* Hearing assistance suitability determining system
100*u*, 1002 Hearing-aid user
101, 801 Audiometer
102, 802 Headphones
103 First hearing level input unit
103*a* Hearing ability information input unit
104 Second hearing level input unit
105 Hearing ability type determining unit
106, 605 Suitability calculating unit
106*a* Suitability determining unit
107, 604 Suitability database
108, 606 Suitability presenting unit
109, 607 Hearing aid setting unit
110 Left-ear hearing aid
111 Right-ear hearing aid
501 Screen
502 Display space for suitability
503 Display space for average amount of improvement
504 Display space for average amount of improvement for speech sound
505 Input space for high-tone-assigned ear
506 Input space for crossover frequency
507 Button
601 Speech sound hearing level input unit
602 Phoneme accuracy rate calculating unit
603 Phoneme suitability calculating unit
803 Hearing level input unit
804 Amplification amount calculating unit
805 Amplification amount display unit
806 Hearing aid setting unit
807 Hearing aids
1001 Speaker
1003 Microphone
1004, 1007, 1008 Speech signal
1005 Low-pass filter

1006 High-pass filter
1009 Speech
1101 Auditory filter measuring unit
1102 Frequency resolution calculating unit

The invention claimed is:

1. A hearing assistance suitability determining device comprising:

a processor; and a non-transitory memory storing thereon a program which is executed by the processor the program causes the processor to:

receive hearing ability information indicating hearing levels of a subject for respective frequencies;

determine at least one of hearing ability types that corresponds to the hearing ability information, based on a tendency in a change of the hearing levels with respect to the frequencies derived from the received hearing ability information and first predetermined correspondence relationship between each of frequency tendencies and each of the hearing ability types;

determine a suitability of the subject for dichotic hearing assistance based on the determined hearing ability type and corresponding second predetermined correspondence relationship, the second predetermined correspondence relationship indicating, for each of the hearing ability types, amounts of clarity improvement each indicating a degree by which a clarity of each of the speech sounds perceived by the subject is improved by the dichotic hearing assistance, the speech sounds including vowels, consonants and a combination of the vowels and the consonants; and present the determined suitability, wherein the suitability is determined based on the amounts of clarity improvement corresponding to the determined hearing ability type.

2. The hearing assistance suitability determining device according to claim 1, the program further causing the processor to:

receive, from the subject, a response to a speech audiometry test; and calculate a phoneme accuracy rate based on the received response, the phoneme accuracy rate indicating, for each phoneme, whether or not the subject has accurately heard a speech sound, the phoneme including vowels and the consonants, and determine the suitability is determined based on (i) the amount of clarity improvement for the speech sound that corresponds to the determined hearing ability type and (ii) the calculated phoneme accuracy rate for the phoneme.

3. The hearing assistance suitability determining device according to claim 1, the program further causing the processor to hold the correspondence relationship for each of crossover frequencies in the dichotic hearing assistance, determine, among the crossover frequencies, a crossover frequency at which the dichotic hearing assistance is most effective for the subject to accurately hear the speech sound, based on the amount of clarity improvement for the speech sound that corresponds to the determined hearing ability type, and present the determined crossover frequency.

4. The hearing assistance suitability determining device according to claim 1, the program further causing the processor to output, to hearing aids, setting information that allows the hearing aids to provide the subject with the dichotic hearing assistance.

5. The hearing assistance suitability determining device according to claim 1, the program further causing the processor to determine, as the suitability, the amount of clarity improvement for the speech sound that corresponds to the determined hearing ability type.

6. The hearing assistance suitability determining device according to claim 1, the program further causing the processor to determine, as the suitability, an average value of amounts of clarity improvement for respective speech sounds that correspond to the determined hearing ability type.

7. The hearing assistance suitability determining device according to claim 2, the program further causing the processor to determine, as the suitability, the amount of clarity improvement that corresponds to the phoneme accuracy rate for the calculated phoneme, for the determined hearing ability type.

8. The hearing assistance suitability determining device according to claim 2, the program further causing the processor to determine, as the suitability, an average value of amounts of clarity improvement each corresponding to a different one of the calculated phoneme accuracy rates for respective phonemes, for the determined hearing ability type.

9. A hearing assistance suitability determining method comprising:

receiving hearing ability information indicating hearing levels of a subject for respective frequencies;

determining at least one of hearing ability types that corresponds to the hearing ability information, based on a tendency in a change of the hearing levels with respect to the frequencies derived from the hearing ability information and first predetermined correspondence relationship indicating a relationship between each of frequency tendencies and each of the hearing ability types;

determining a suitability of the subject for dichotic hearing assistance based on the determined hearing ability type and corresponding second predetermined correspondence relationship, the second predetermined correspondence relationship indicating, for each of the hearing ability types, amounts of clarity improvement each indicating a degree by which a clarity of each of the speech sounds perceived by the subject is improved by the dichotic hearing assistance, the speech sounds including vowels, consonants and a combination of the vowels and the consonants; and presenting the determined suitability, wherein, the suitability is determined based on the amounts of clarity improvement corresponding to the determined hearing ability type.

10. A non-transitory computer-readable recording medium for use in a computer, the recording medium having a computer program recorded thereon for causing the computer to execute the hearing assistance suitability determining method according to claim 9.

* * * * *